United States Patent [19]

Marietta

[11] 4,162,874

[45] Jul. 31, 1979

[54] HORSEPOWER SUMMATION CONTROL FOR VARIABLE DISPLACEMENT

[75] Inventor: Walter E. Marietta, Mentor, Ohio

[73] Assignee: Parker-Hannifin Corporation, Cleveland, Ohio

[21] Appl. No.: 848,786

[22] Filed: Nov. 7, 1977

[51] Int. Cl.[2] ..... F04B 49/00

[52] U.S. Cl. ..... 417/216; 60/428

[58] Field of Search ..... 417/216; 60/428, 486

[56] References Cited

U.S. PATENT DOCUMENTS

| | | | |
|---|---|---|---|
| 3,726,093 | 4/1973 | Malott | 60/445 |
| 3,941,513 | 3/1976 | Malott | 417/212 |
| 3,941,514 | 3/1976 | Louis et al. | 417/216 |
| 3,945,764 | 3/1976 | Marietta | 417/212 |
| 4,080,979 | 3/1978 | Hein | 417/216 X |

*Primary Examiner*—Carlton R. Croyle
*Assistant Examiner*—Edward Look
*Attorney, Agent, or Firm*—Maky, Renner, Otto & Boisselle

[57] ABSTRACT

Two variable displacement pumps each having a horsepower (or torque) control valve, a pressure limiting valve, and a displacement feedback valve are interconnected to provide fluid flow paths from the high pressure zone of one pump to the low pressure zone of the other pump via the horsepower control valve and the displacement feedback valve of the respective pumps and vice versa. When one pump is utilizing less than one-half of the available engine torque as at deadhead operation or low displacement operation wherein its pressure limiting valve determines the maximum delivery pressure or wherein the pump is in standby operation, its displacement feedback valve will correspondingly increase the back pressure of the horsepower control valve of the other pump so that the latter may utilize the torque deficiency of the former to bring the total torque utilization of both pumps to the engine torque limit.

8 Claims, 7 Drawing Figures

HORSEPOWER SUMMATION CONTROL FOR VARIABLE DISPLACEMENT

BACKGROUND OF THE INVENTION

Axial piston variable displacement pumps with pressure and horsepower compensated hydraulic swash plate actuators are well known in the art as disclosed, for example, in the Malott U.S. Pat. Nos. 3,726,093 and 3,941,513 and in the Marietta U.S. Pat. No. 3,945,764. When two such pumps are required in parallel in a hydraulic system driven by the same engine having a predetermined horsepower limit, the horsepower controls of the pumps are generally set to torque limits equal to one-half the utilizable engine torque. However, in the operation of said hydraulic system, when one pump is deadheading or is in standby condition or is operating at low displacement, the torque limit thereof may be considerably less than one-half the utilizable torque while the torque limit of the other pump remains at one-half the utilizable engine torque, whereby the fluid motor actuated by said other pump is actuated at lower speed and/or lower pressure than would be potentially possible if the unutilized torque were made available to said other pump.

SUMMARY OF THE INVENTION

In a two pump system of the type referred to above, each pump has a horsepower control valve, a pressure limiting valve, and a displacement feedback valve, the pumps being hydraulically interconnected so that the displacement feedback valve of each pump varies the back pressure on the horsepower control valve of the other pump so that when the torque limit of either pump is less than one-half the utilizable torque limit, the torque limit of the other pump is correspondingly increased so that the total of the torque limits is substantially equal to the utilizable torque limit of the engine.

The two pump system herein also enables utilizing the maximum displacement of both pumps at reduced pressure, enables operation of both pumps at limited displacement but maximum pressure, or enables various combinations within the total maximum torque limit.

Other objects and advantages will appear from the ensuing description.

DETAILED DESCRIPTION OF A PREFERRED EMBODIMENT

Figure 1:
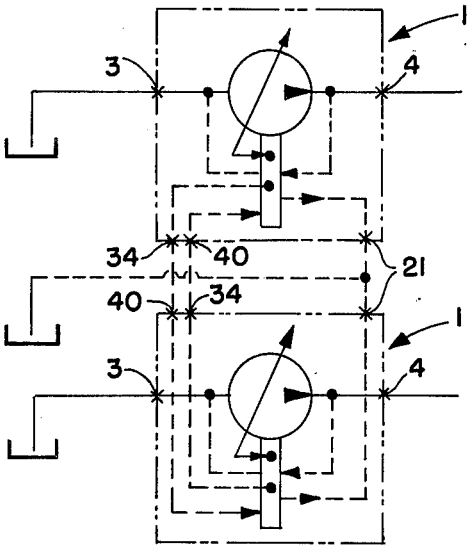
FIG. 1 is a schematic diagram of a two pump system embodying the present invention.
Figure 2:
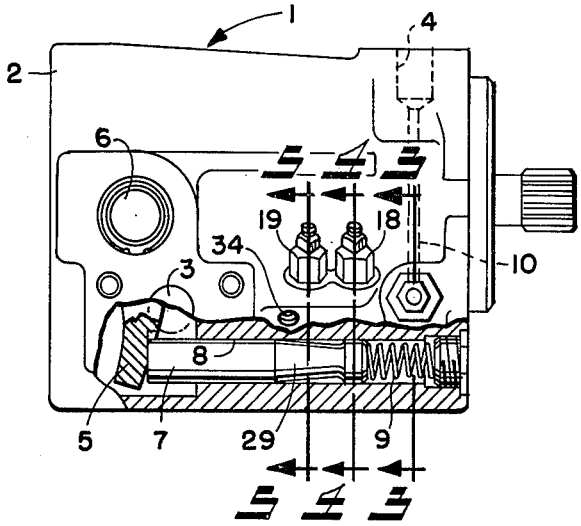
FIG. 2 is a side elevation view partly in cross section of a variable displacement pump according to the present invention.
Figure 3:
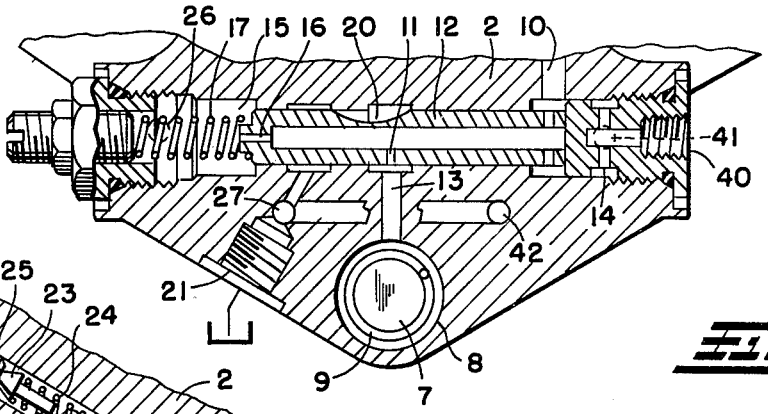
FIGS. 3, 4 and 5 are cross section views taken substantially along the lines 3—3, 4—4 and 5—5 of FIG. 2.
Figure 4:
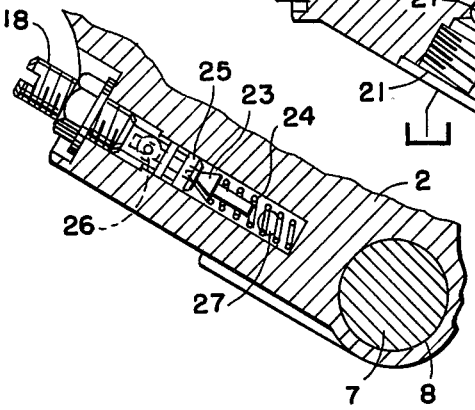

Referring first to FIGS. 2–5, each variable displacement pump 1 of the two pump system as shown in FIG. 1 comprises a housing 2 having an inlet port 3 and an outlet port 4. The pump 1 is preferably of the axial piston type as shown in the aforesaid patents and the displacement of the pump 1 varies according to the angular position of the swash plate 5 which is pivoted at 6 to the housing 2. The swash plate 5 is actuated to different angular positions by the swash plate actuating member or piston 7 which is slidable in the bore 8 of the housing 2 and which is biased by the spring 9 toward the swash plate 5.

Fluid under pressure from the high pressure zone of the pump 1 is conducted into bore 8 via a housing passage 10, an orifice 11 in the modulator 12, and a housing passage 13 downstream of the orifice 11. When the modulator 12 is in the position shown in FIG. 3, the pressures in the chambers 14 and 15 at one end are equalized via the modulator orifice 16 whereby the spring 17 biases the modulator 12 to that position. However, when the pressure in the chamber 15 is decreased by opening of the pressure limiting valve 18 (FIG. 4) or by opening of the horsepower control valve 19 (FIG. 5) and the resulting pressure drop across the orifice 16, the predominant pressure in the chamber 14 will urge the modulator 12 toward the left as viewed in FIG. 3 to decrease the pressure in the swash plate actuator bore 8 by bleeding the same through the bleed orifice 20 to the drain passage and port 21 whereby the swash plate actuator 7 will move to the right as viewed in FIG. 2 for decreased displacement of the pump 1.

The pressure limiting valve 18 comprises a valve member 23 biased by the spring 24 into engagement with a seat at the end of the adjustable valve body 25, the upstream side of the valve member 23 being communicated with the pressure chamber 15 by way of the passage 26 and the downstream side being communicated with the drain passage and port 21 by way of the passage 27. As evident, the turning of the valve body 25 in opposite directions will increase or decrease the compression of the spring 24 whereby, when the pressure in the chamber 15 reaches a value sufficient to force the valve member 23 away from its seat, there will be a reduction in pressure in the chamber 15 with respect to the pressure in chamber 14 with consequent movement of the modulator 12 as previously mentioned to cause the pump 1 to be adjusted to decreased displacement.

The horsepower control valve 19 is of construction similar to that of the pressure limiting valve 18 except that a spring follower 28 in the form of a ball engages a cam surface 29 on the swash plate actuator 7 to increase the biasing force of the spring 30 on the valve member 31 as the swash plate actuator 7 moves in displacement decreasing direction. The initial spring load is adjusted by turning the horsepower control valve body 32 in one direction or the other. The upstream side of the horsepower control valve member 31 is communicated with the pressure chamber 15 via the passage 26 and the downstream side is communicated with the passage and port 34.

Figure 5:
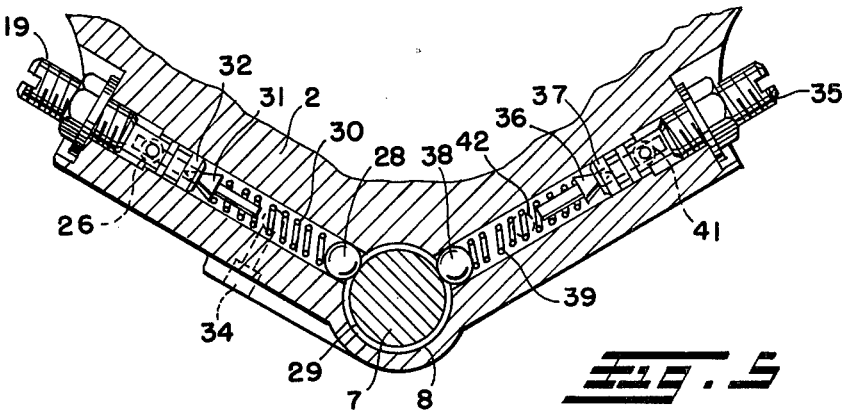

As shown in FIG. 5, the housing 2 has a displacement feedback valve 35 therein which is of construction similar to that of the horsepower control valve 19, that is, it includes a valve member 36 engageable and disengageable from a seat in the adjustable valve body 37 and has a follower 38 for the spring 39 in the form of a ball also engaged with the cam 29 of the swash plate actuator 7. The upstream side of the displacement feedback valve member 36 is communicated with the port 40 by way of housing passage 41 and the downstream side is communicated with the drain passage and port 21 by way of the housing passage 42.

When two pumps are interconnected as in FIG. 1, that is, with the port 34 of each pump 1 connected to the port 40 of the other pump 1, there is provided a horsepower summation control in which the sum of the torque limits of the two pumps 1 will substantially equal the utilizable engine torque.

Figure 6:
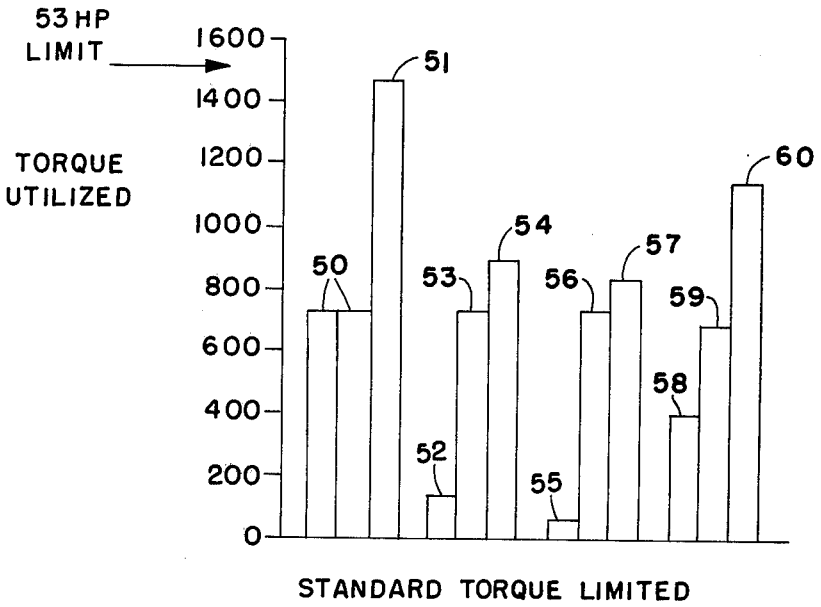
FIG. 6 is a bar graph illustrating torque utilization in a standard two pump system.

As shown in FIG. 6, in a standard torque limited two pump system, the horsepower control valves will be set to torque limits 50 equal to one-half the utilizable torque 51. However, when one pump is deadheading, the torque limit 52 is very small in comparison with the torque limit 53 of the other pump and hence the total torque utilization 54 is considerably less than could be utilized as indicated by the 53 HP limit of the engine. Similarly, when one pump is in standby operation, the torque limit 55 is very small in comparison to the torque limit 56 of the other pump, with consequent small total torque utilization 57. When one pump is operated to its torque limit 58 at, say, 20% capacity while the other pump is operated to its torque limit 59, the total utilized torque 60, while somewhat greater than in the case of deadheading or standby operation aforesaid, is yet considerably less than the total utilizable torque 51.

Figure 7:
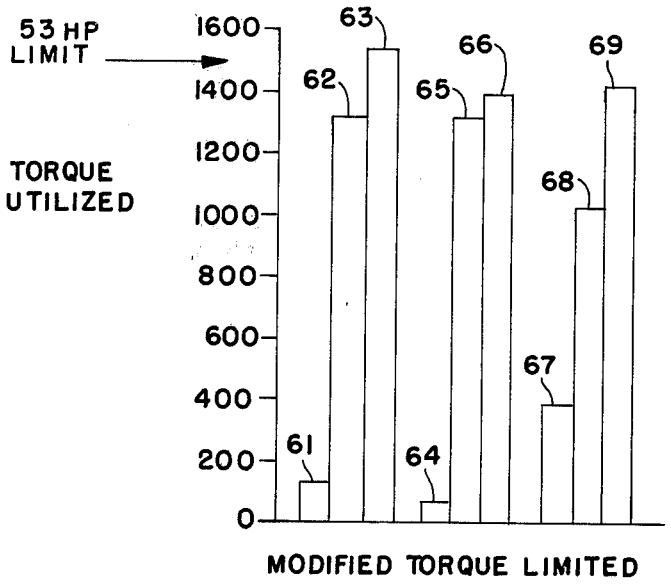
FIG. 7 is similar to FIG. 6 except illustrating the torque utilization in the present two pump system.

When two pumps 1 embodying the present invention are interconnected as in FIG. 1, each pump 1 may be initially adjusted to a torque limit 50 (see FIG. 6) which is equal to about one-half the utilizable torque 51 by adjusting each horsepower control valve 19. This adjustment may be made without spring 39 pressure on the respective displacement feedback valves 35 to which the downstream sides of the horsepower control valves 19 are connected. This is shown in the left hand side of FIG. 6 wherein the total torque utilization 51 corresponds to the utilizable engine torque. With the modified torque limited system as shown in FIG. 7, when one pump 1 is deadheading with a torque limit 61 as indicated, the other pump 1, by reason of the compression of the spring 39 of the displacement feedback valve 35 of said one pump, while the swash plate 5 is in low displacement position, results in increased back pressure on the horsepower control valve 19 of said other pump 1 so that the torque limit 62 thereof is increased substantially whereby the total torque utilization 63 is substantially equal to the engine torque utilization limit. Similarly, when one pump 1 is in standby operation with a torque limit 64, again the back pressure feedback from the displacement feedback valve 35 of said one pump 1 to the horsepower control valve 19 of said other pump 1 increases the torque limit 65 of said other pump 1 as shown, whereupon again the total utilization 66 is quite close to the utilizable engine torque limit. Similarly, when one pump 1 is operated at its torque limit 67 at say 20% capacity as shown, the other pump 1 has a torque limit 68 with a total utilization 69. The torque limit 68 is greater than the initial one-half limit but less than the torque limit 62 or 65 when the one pump 1 is at deadhead or in standby operation owing to the lower back pressure on the horsepower control valve 19 of said other pump 1.

I, therefore, particularly point out and distinctly claim as my invention:

1. A horsepower summation control for first and second variable displacement pumps each having pump means, high and low fluid pressure zones, displacement adjusting means including a fluid pressure operated member to increase the displacement of said pump means in response to increase in fluid pressure in said high pressure zone, pressure compensating means operative, upon increase of fluid pressure in said high pressure zone to a predetermined value, to intercommunicate said high and low pressure zones for movement of said member in displacement decreasing direction, a spring-biased horsepower control valve, a spring-biased displacement feedback control valve, and cam means on said fluid pressure operated member operative upon movement in displacement decreasing direction to increase the spring bias on said valves; said pumps being interconnected to define a fluid flow path from the high pressure zone of each pump via its horsepower control valve to the low pressure zone of the other pump via its displacement feedback control valve.

2. The horsepower summation control of claim 1, wherein each fluid pressure operated member has restricted communication with said high pressure zone; and wherein each pump has a modulator which, in response to opening of said pressure compensating means or said horsepower control valve, opens a bleed passage from said member to said low pressure zone for movement of said member in displacement decreasing direction.

3. A horsepower summation control for first and second variable displacement pumps each having pump means, high and low pressure zones, output adjusting means including a fluid pressure actuated member having restricted communication with said high pressure zone and operatively engaged with said pump means to vary the displacement thereof, a modulator having opposed areas respectively exposed to said high pressure zone and to said high pressure zone via orifice means and movable, upon pressure drop across said orifice means, to open a bleed passage from said fluid pressure actuated member to said low pressure zone for movement of the latter in displacement decreasing direction, a pressure limiting valve operative upon increase of fluid pressure in said high pressure zone to predetermined value to open communication of the last-mentioned area with said low pressure zone whereby the difference in fluid pressures acting on said opposed areas effects movement of said modulator and fluid pressure actuated member as aforesaid, a horsepower control valve operative upon increase of fluid pressure in said high pressure zone in relation to displacement to open communication of the last-mentioned area with the low pressure zone of the other pump, and a displacement feedback control valve having its downstream side communicated with said low pressure zone operative in response to decreasing displacement to establish an increasing back pressure on its upstream side to the horsepower control valve of the other pump.

4. The horsepower summation control of claim 3 wherein each fluid pressure actuated member has cam means engaging spring followers of said horsepower control and displacement feedback control valves.

5. The horsepower summation control of claim 3, wherein each pump has means for increasing the opening pressure of said horsepower control valve and said displacement feedback control valve in response to movement of said fluid pressure actuated member in displacement decreasing direction.

6. The horsepower summation control of claim 5, wherein said means for increasing opening pressure increases the bias of spring means on said horsepower control valve and said displacement feedback control valve.

7. A horsepower summation control for first and second variable displacement pumps each having pump means, high and low fluid pressure zones, displacement adjusting means including a fluid pressure operated member to increase the displacement of said pump means in response to increase in fluid pressure in said high pressure zone, pressure compensating means operative, upon increase of fluid pressure in said high pressure zone to a predetermined value, to intercommunicate said high and low pressure zones for movement of said member in displacement decreasing direction, a spring-biased horsepower control valve, a spring-biased displacement feedback control valve, and means for increasing the spring bias on said valves in response to movement of said fluid pressure operated member in displacement decreasing direction; said pumps being interconnected to define a fluid flow path from the high pressure zone of each pump via its horsepower control valve to the low pressure zone of the other pump via its displacement feedback control valve.

8. The horsepower summation control of claim 7, wherein each fluid pressure operated member has restricted communication with said high pressure zone; and wherein each pump has a modulator which, in response to opening of said pressure compensating means or said horsepower control valve, opens a bleed passage from said member to said low pressure zone for movement of said member in displacement decreasing direction.

* * * * *